US005726691A

United States Patent [19]

Shioya et al.

[11] Patent Number: 5,726,691

[45] Date of Patent: Mar. 10, 1998

[54] RECORDING APPARATUS AND METHOD FOR RECORDING DROPLETS IN REGISTRY

[75] Inventors: Makoto Shioya, Tokyo; Takeshi Okazaki, Yokohama, both of Japan

[73] Assignee: Canon Kabushiki Kaisha, Tokyo, Japan

[21] Appl. No.: 801,362

[22] Filed: Feb. 19, 1997

Related U.S. Application Data

[63] Continuation of Ser. No. 114,237, Sep. 1, 1993, abandoned, which is a continuation of Ser. No. 659,277, Feb. 22, 1991, abandoned.

[30] Foreign Application Priority Data

Feb. 26, 1990 [JP] Japan ..... 2-042513
Nov. 30, 1990 [JP] Japan ..... 2-329742

[51] Int. Cl.[6] ..... B41J 2/205

[52] U.S. Cl. ..... 347/15; 347/40

[58] Field of Search ..... 347/15, 40, 43

[56] References Cited

U.S. PATENT DOCUMENTS

| | | | |
|---|---|---|---|
| 3,404,221 | 10/1968 | Loughren | 346/140 X |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,538,160 | 8/1985 | Uchiyama | 346/140 R |
| 4,558,333 | 12/1985 | Sugitani et al. . | |
| 4,631,548 | 12/1986 | Milbrandt | 346/140 R X |
| 4,723,129 | 2/1988 | Endo et al. . | |
| 4,740,796 | 4/1988 | Endo et al. . | |
| 4,746,935 | 5/1988 | Allen | 346/140 R |
| 4,963,882 | 10/1990 | Hickman | 346/140 R X |
| 5,075,689 | 12/1991 | Hoisington | 346/140 R X |

FOREIGN PATENT DOCUMENTS

| | | |
|---|---|---|
| 0259541 | 3/1988 | European Pat. Off. . |
| 0376596A3 | 7/1990 | European Pat. Off. . |
| 58-56847 | 5/1979 | Japan . |
| 54-133338 | 10/1979 | Japan . |
| 59-123670 | 7/1984 | Japan . |
| 59-138461 | 8/1984 | Japan . |
| 60-71260 | 4/1985 | Japan . |
| 60-262663 | 12/1985 | Japan . |
| 63-295270 | 12/1988 | Japan . |
| 1556828 | 5/1980 | United Kingdom . |

OTHER PUBLICATIONS

Eur. Pat. Off. Search Report for Eur. Pat. App. No. 91301516.0.

Brit. Pat. Off. Search Report for Brit. Pat. App. No. 9103908.1.

*Primary Examiner*—Joseph W. Hartary

*Attorney, Agent, or Firm*—Fitzpatrick, Cella, Harper & Scinto

[57] ABSTRACT

The present invention is directed to a recording apparatus; using an ink-jet recording head for discharging ink from an array of a plurality of orifices, including a drive unit for driving the recording head on the basis of a recording signal to cause a first orifice of the plurality of orifices to discharge ink at a first timing, and to cause a second orifice to discharge ink at a second timing, and a moving unit for moving the recording head and a recording medium relative to each other by an amount corresponding to a distance between the first and second orifices during a time interval between the first and second timings by the drive unit.

37 Claims, 6 Drawing Sheets

RECORDING APPARATUS AND METHOD FOR RECORDING DROPLETS IN REGISTRY

This application is a continuation of application Ser. No. 08/114,237, filed Sep. 1, 1993, which was a continuation of application Ser. No. 07/659,277, filed Feb. 22, 1991, both now abandoned.

BACKGROUND OF THE INVENTION

1. Field of the Invention

The present invention relates to a recording apparatus using an ink-jet recording head and a recording method and, more particularly, to an ink-jet recording apparatus for applying a plurality of ink droplets to the same portion of a recording medium to form one dot, and expressing gradation depending on the number of ink droplets which are applied, and a recording method.

2. Related Background Art

When recording is performed by an ink-jet recording apparatus, as a conventional method of expressing gradation in, e.g., an image to be recorded, various methods are known.

For example, a method of changing the area of a dot formed by ink droplets on a recording medium by changing the size of the ink droplets to be discharged by various means (area gradation method), a method of expressing gradation by changing the number of dots forming one pixel which is formed by a plurality of dots formed at different positions (a density pattern method, a dither method, and the like), a method of performing recording using inks having different densities (shading ink method), a method of applying a plurality of ink droplets to the same portion of a recording medium to form one dot, and changing the dot area (density) in accordance with the number of ink droplets applied, thereby expressing gradation (multi-droplet method), and the like are known.

On the other hand, as a recording method capable of achieving high-speed, high-density recording, a method wherein bubbles are formed by utilizing heat energy generated by electrothermal converters of a recording head, and an ink is discharged based on a change in pressure caused by a change in state of the ink has been recently received much attention. Since the ink-jet method utilizing the heat energy cannot practically change the size of ink droplets, the multi-droplet method described above is effective as a method of expressing gradation. Since the size of one pixel can be reduced as compared to the density pattern method or the dither method, high-resolution recording can be performed. Unlike the shading ink method, a plurality of inks for the same color need not be employed. Thus, the ink-jet method also offers the advantages of simpler apparatus arrangement.

However, in the conventional multi-droplet method, recording gradation cannot often be changed in correspondence with a change in the number of ink droplets applied, or dot diameters (densities) vary even if dots are formed by the same number of ink droplets. As a result, the gradation range of the entire image to be recorded is narrowed, resulting in poor sharpness.

In the conventional multi-droplet method, in order to form one dot, i.e., one pixel in this case, a plurality of ink droplets discharged from the same orifice land on the recording medium to form the pixel. For this reason, consecutive applications of the plurality of droplets cannot be more frequent than the discharging frequency. As a result, the first ink droplet may soak in the recording medium, or the ink's solvent may evaporate before the next ink droplet lands, and so the ink cannot spread properly. As a result, even if a plurality of ink droplets land, the dot diameter undesirably becomes smaller than a desired size corresponding to the number of ink droplets to land. In this manner, the conventional multi-droplet method suffers from a problem of impaired gradation of an image caused by the relatively long application intervals.

When the dot densities formed by ink droplets discharged from orifices vary depending on variations of discharging diameters or opening directions of the orifices, variations of dot densities (density nonuniformity) become more conspicuous in the conventional multi-droplet method since one dot is formed by discharging a plurality of ink droplets from the same orifice.

SUMMARY OF THE INVENTION

It is an object of the present invention to provide a recording apparatus capable of producing a high-gradation and sharp image by using an ink-jet recording head, and a recording method.

It is another object of the present invention to provide an ink-jet recording apparatus which can shorten the intervals at which ink droplets can be applied to form a pixel having a desired size, and a recording method.

It is still another object of the present invention to provide an ink-jet recording apparatus free from variations of densities among pixels to be formed, and a recording method.

In order to achieve the above objects, according to the present invention, there is provided a recording apparatus for performing recording using an ink-jet recording head for discharging an ink from an array of a plurality of orifices.

This device has drive means for driving the recording head on the basis of a recording signal to cause a first orifice of the plurality of orifices to discharge ink at a first timing, and to cause a second orifice to discharge an ink at a second timing. Further, it includes moving means for moving the recording head and a recording medium relative to each other by an amount corresponding to a distance between the first and second orifices during a time interval between the first and second timings by the drive means.

In order to achieve the above objects, according to the present invention, there is provided a recording method for performing recording using an ink-jet recording head for discharging an ink from an array of a plurality of orifices. This method involves a first step of causing a first orifice of the recording head to discharge an ink to a predetermined position of a recording medium, a second step of moving a second orifice of the recording head relative to the predetermined position of the recording medium after the first step, and a third step of causing the second orifice to discharge the ink to the predetermined position of the recording medium after the second step.

DETAILED DESCRIPTION OF THE PREFERRED EMBODIMENTS

The preferred embodiments of the present invention will be described in detail hereinafter with reference to the accompanying drawings.

(First Embodiment)

Figure 1:
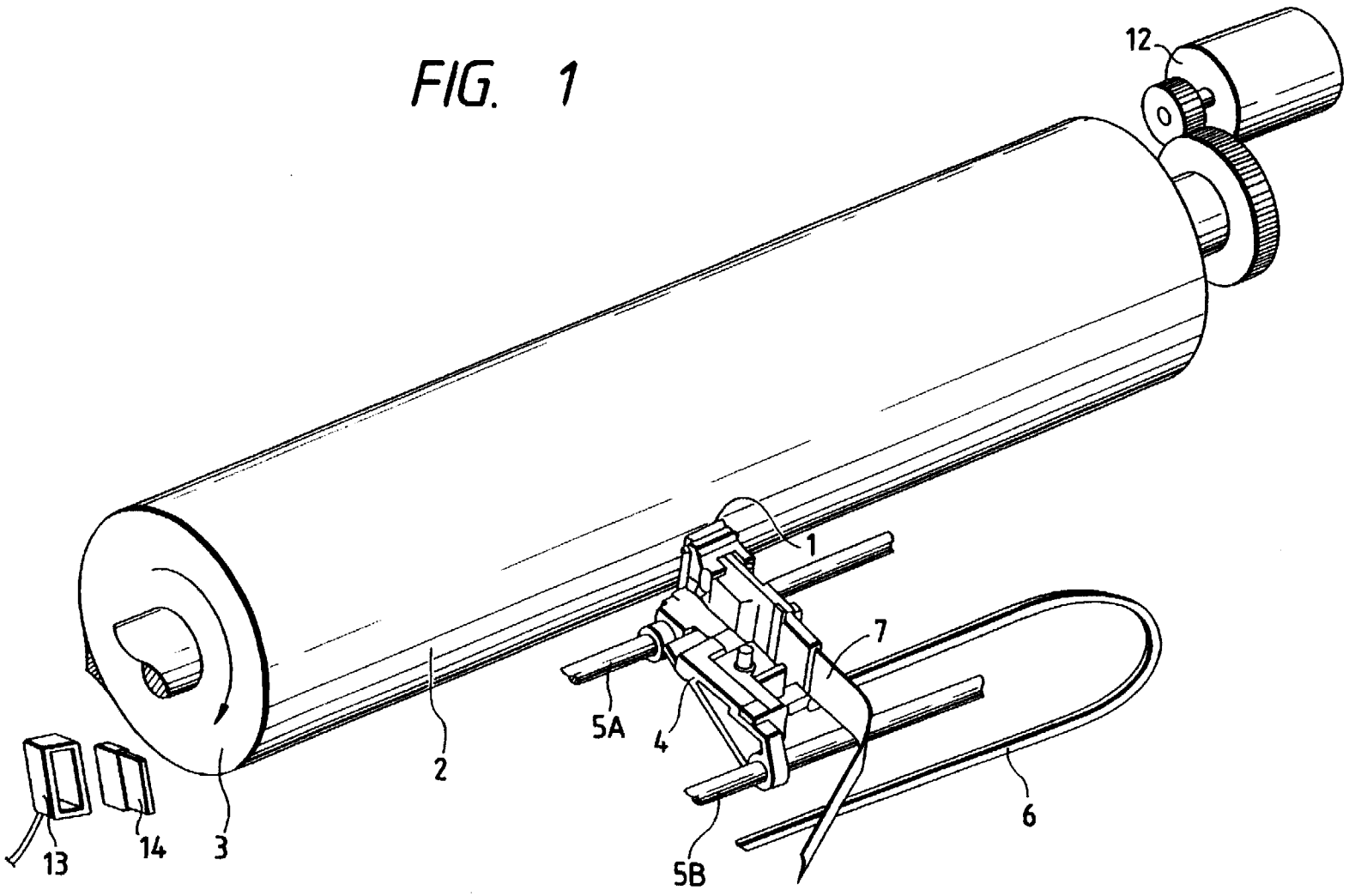
FIG. 1 is a schematic perspective view of an ink-jet recording apparatus according to an embodiment of the present invention.

FIG. 1 is a schematic perspective view showing an ink-jet recording apparatus according to an embodiment of the present invention. In FIG. 1, a recording head 1 has 32 ink orifices at a density of 16 orifices/mm, i.e., an orifice separation of 62.5 μm. Each orifice comprises an electrothermal converter for generating and applying discharging energy to a liquid channel communicating with it. The electricity-heat converter generates heat in accordance with an electrical pulse applied thereto, and causes film boiling in an ink. An ink is discharged from each orifice in correspondence with growth of bubbles caused by the film boiling. In this embodiment, a discharging frequency at each orifice, i.e., a drive frequency of the electricity-heat converter is 2 kHz (pulse interval=500 μsec).

A carriage 4 mounts the recording head 1, and is movably guided along two guide shafts 5A and 5B which are slidably engaged with a portion of the carriage 4. An ink supply tube 6 supplies an ink from an ink tank (not shown) to the recording head 1. A flexible cable 7 transmits a drive signal based on recording data and a control signal from a control unit (not shown) of the apparatus of this embodiment to a head drive circuit arranged in a portion of the recording head 1. The ink supply tube 6 and the flexible cable 7 are formed of flexible members so as to be able to follow movement of the carriage 4. The carriage 4 is connected to a portion of a belt (not shown), parallel to the guide shafts 5A and 5B, for moving the carriage 4. When the belt is driven by a carriage motor (not shown), the carriage 4 can be moved.

A cylindrical drum 3 extends to be parallel to the guide shafts 5A and 5B in its longitudinal direction, and is rotated by a drive means comprising, e.g., a motor 12, in a direction of an arrow in FIG. 1 at a tangential velocity of 625 mm/sec on the drum. A recording paper sheet 2 having, e.g., an A1 size, as a recording medium is mounted along the cylindrical side surface of the drum 3 to cover the entire surface. Thus, the recording head 1 can discharge an ink to a portion of the recording paper 2 facing the orifices upon movement of the carriage 4 to perform recording.

A cap 13 and a blade 14 are arranged near the end portion of the drum 3. The cap 13 and the blade 14 can be inserted in or removed from the moving path of the recording head 1 upon movement of the head 1. The blade 14 is engaged with an orifice surface of the recording head 1 to wipe it clean. Thus, dew drop attached to the orifice surface can be removed.

The cap 14 covers and closes the orifice surface, and draws ink in the orifices by a suction force of, e.g., a pump (not shown), thereby preventing ink from being dried in a non-recording state.

Figure 2:
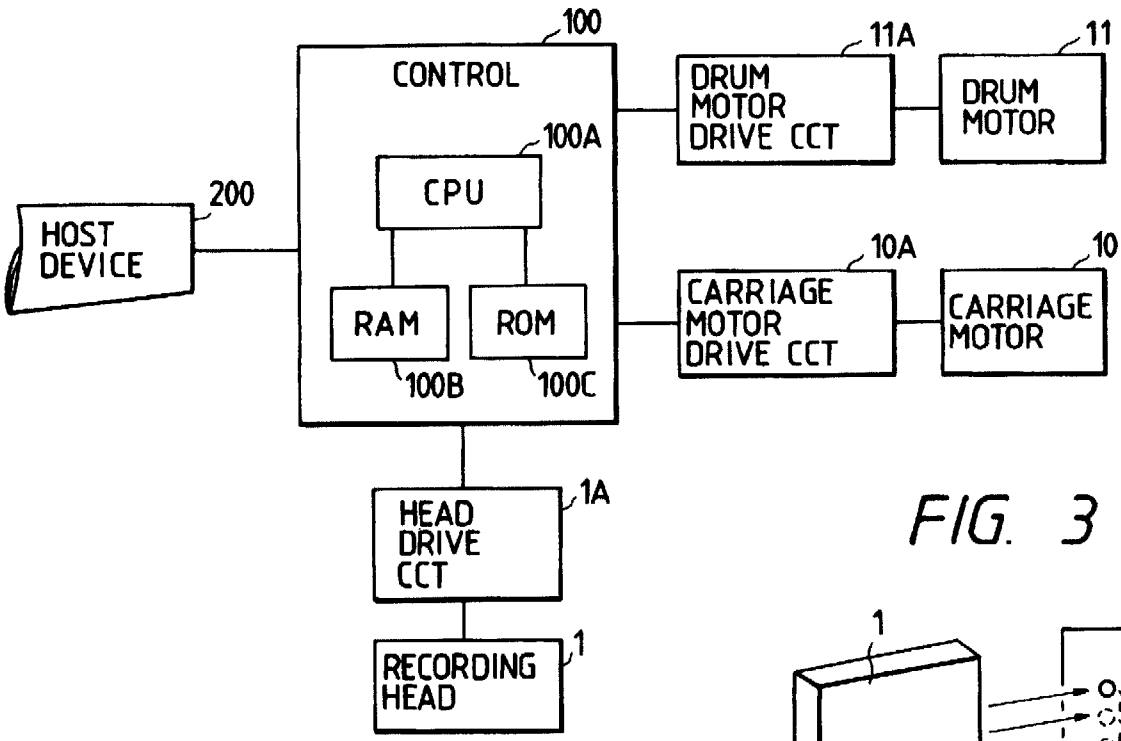
FIG. 2 is a block diagram showing a control arrangement of the ink-jet recording apparatus.

FIG. 2 is a block diagram showing a control arrangement of the ink-jet recording apparatus shown in FIG. 1. In FIG. 2, a control unit 100 is arranged in a predetermined portion of the apparatus of this embodiment in the form of a circuit board. The control unit 100 comprises a CPU 100A for executing processing of the entire apparatus, and control processing of operations, a RAM 100B used as a work area in control processing by the CPU 100A, and a ROM 100C for storing a processing sequence of the control processing.

The CPU 100A controls rotation of a drum motor 11 for rotating the drum 3 and a carriage motor 10 respectively through a drum motor drive circuit 11A and a carriage motor drive circuit 10A. Drive operations of the electrothermal converters of the recording head 1 are controlled on the basis of drive signals based on recording data, and control signals for controlling drive timings, and the like, which are transmitted from the control unit 100. The recording data is supplied from a host device 200 to the control unit 100. As the host device 200, a host computer, a scanner having a reading means, a facsimile receiver for receiving a transmitted facsimile signal, and the like are available.

With the above arrangement, recording control to be described below is performed.

Figure 3:
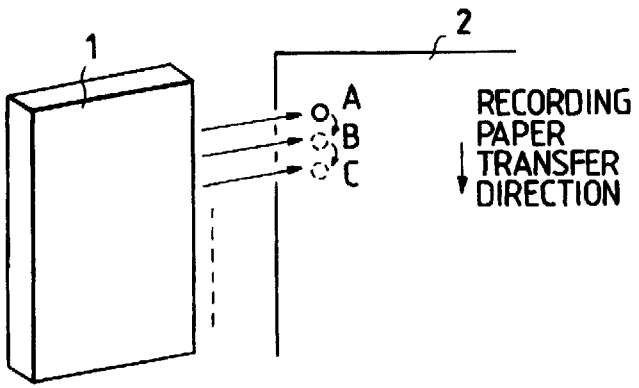
FIG. 3 is a view showing the principle of recording control according to the first embodiment of the present invention.
Figure 4:
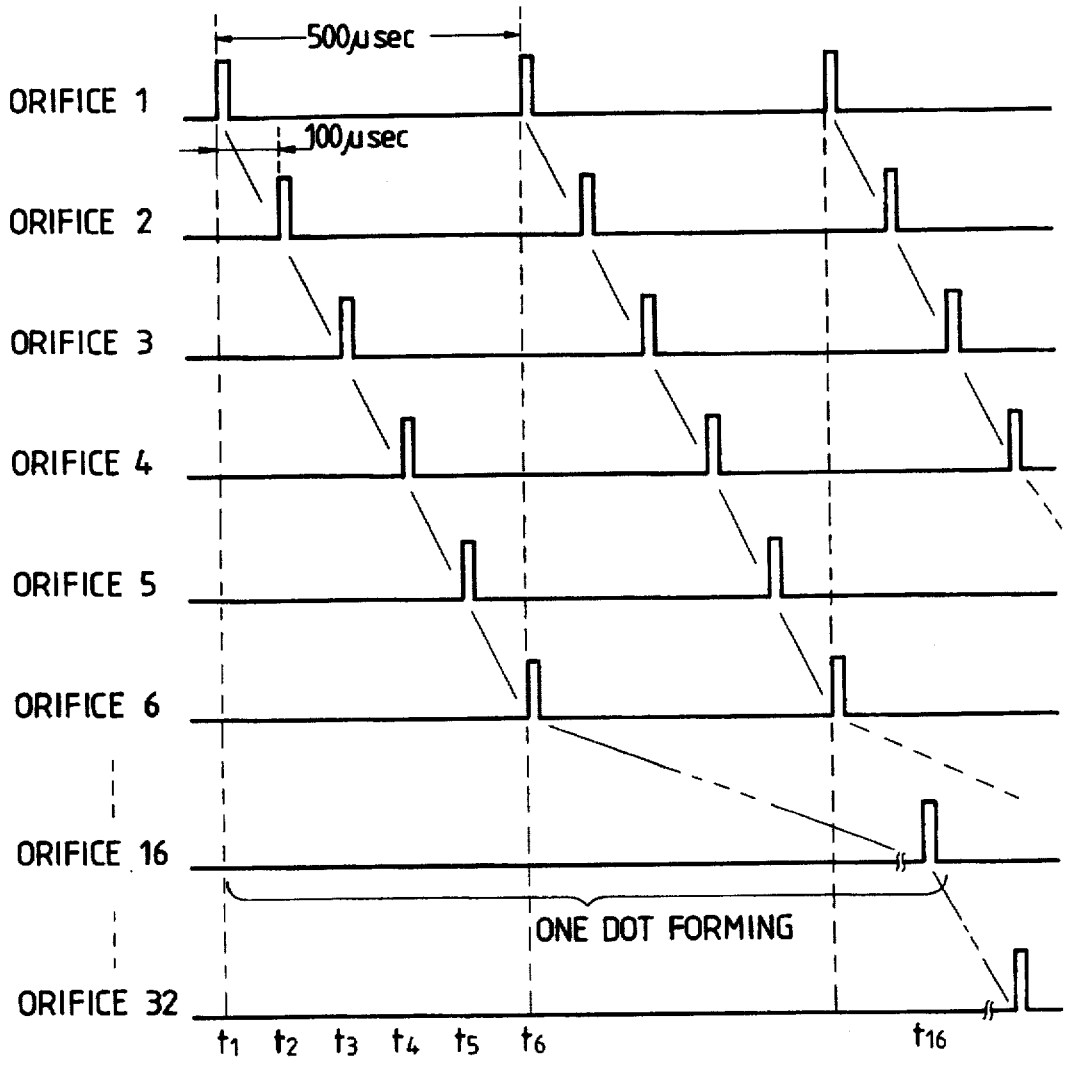
FIG. 4 is a timing chart of a recording head driving operation in the recording control.
Figure 5:
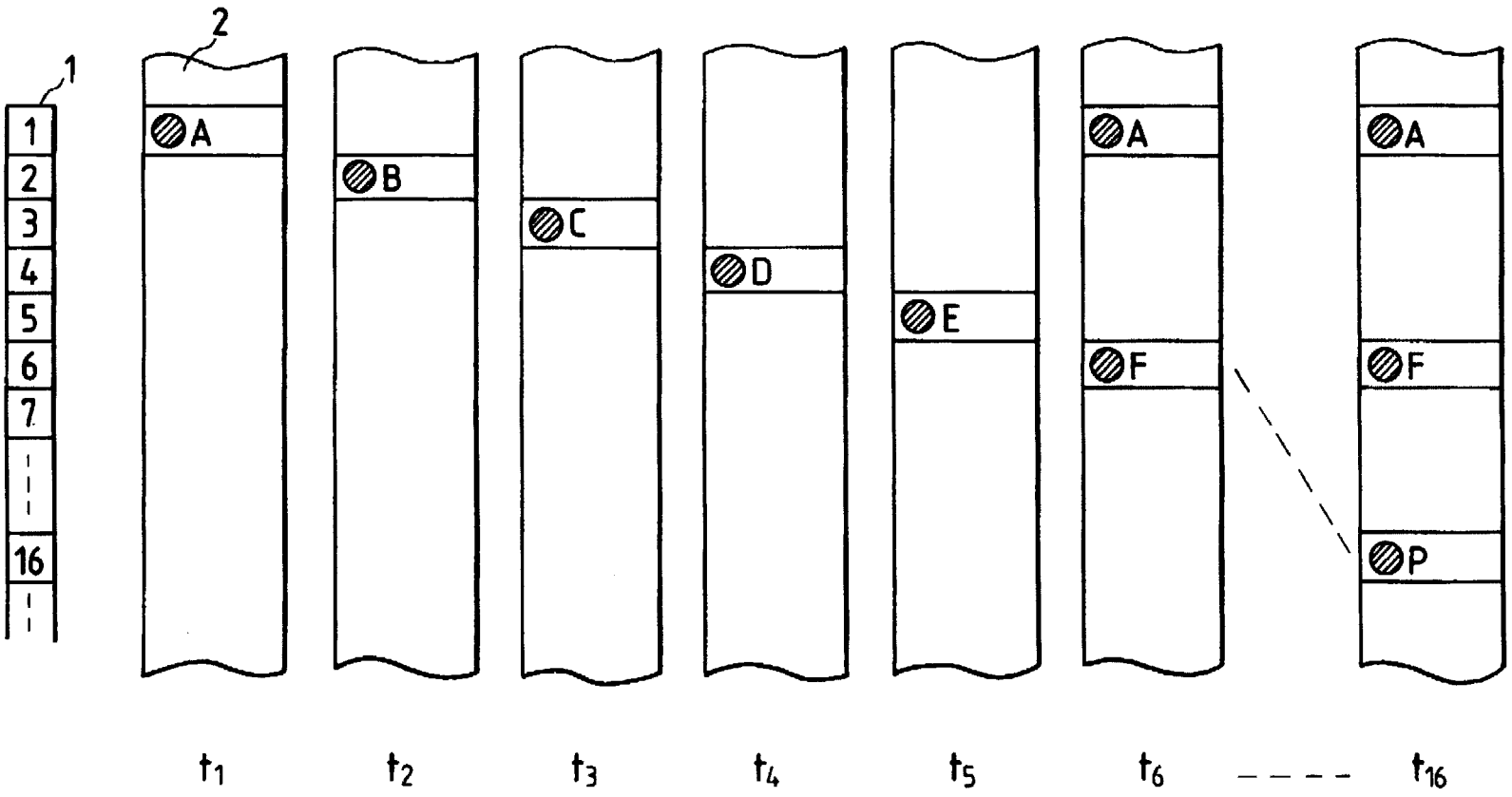
FIG. 5 is a chart showing a pixel forming process in the first embodiment.

FIG. 3 is a view for explaining the principle of recording control according to the embodiment of the present invention, FIG. 4 is a timing chart of a recording head drive operation in the recording control, and FIG. 5 is a view showing a pixel forming process in the recording control. Note that the timing chart of FIG. 4 mainly illustrates possible discharging intervals of each orifice, and discharging intervals among the orifices. In actual recording, discharging intervals of each orifice are determined in consideration of the rotational speed of the drum 3 and the positions of pixels to be formed with respect to the recording paper.

As shown in FIG. 4, each orifice can discharge ink every 500 μsec, which is the time required for refilling of the ink. Among the orifices, ink is discharged at time intervals of about 100 μsec in accordance with the rotational speed of the drum 3 and the distance between the adjacent orifices in this embodiment. As described above, since the tangential velocity of the drum 3 is 625 mm/sec, the drum and each orifice are moved relative to each other by 62.5 μm during an interval of 100 μsec. When an ink is discharged at a discharge frequency of 100 μsec, ink droplets discharged from a plurality of orifices land on the same portion of the recording paper. The discharge intervals can be varied by changing the rotational speed of the drum 3 and the distance between the adjacent orifices.

A formation process of one pixel will be explained below with reference to FIGS. 3 to 5. At timing $t_1$, an ink droplet discharged from a first orifice lands on the recording paper 2 (a dot A in FIGS. 3 and 5). The dot A is moved to a position of a dot B in FIGS. 3 and 5 after the passage of about 100 μsec (timing $t_2$), an ink droplet discharged from a second orifice adjacent to the first orifice lands on the dot B. These operations are repeated to form one pixel. The number of ink droplets for forming one pixel is determined in accordance with the density of a pixel to be formed. For example, when recording is performed at a density half the maximum density of this embodiment (ink is discharged from all the 32 orifices), a pixel is formed by ink droplets discharged from 16 orifices (timing $t_{16}$).

At timing $t_6$ after the passage of 500 μsec from the first discharging operation, the first orifice performs the second discharging operation, thus starting formation of the second pixel at the dot A in FIG. 5. For the second pixel, the 2nd, 3rd, . . . , 32nd orifices discharge to have ink with delay times of 100 μsec like in the first pixel, thereby forming a pixel with a plurality of ink droplets. The drum 3 is rotated once while sequentially repeating such pixel formation. In this embodiment, a discharging interval of one orifice is 500 μsec, and is five times the discharging timing interval of 100 μsec between adjacent orifices. In this case, since an interval between pixels formed by one orifice (e.g., dots A and F in FIG. 5) is five times the interval between the adjacent orifices, the density of a pixel formed during one revolution of the drum is ⅕ times an orifice density. In this manner, since the pixel density becomes relatively small, the drum must be rotated several times in one-line recording to increase the pixel density, thereby forming new pixels between adjacent already formed pixels (e.g., between adjacent ones of dots A to F in FIG. 5). In this embodiment, the drum is rotated five times during one-line recording so as to perform recording at a pixel density of 16 pixels/mm.

After one-line recording is performed in this manner, the carriage 4 is moved to move the recording head 1 to the next line, and the same recording operation is performed. By repeating of these operations, an image can be formed.

As can be apparent from the above description, according to this embodiment, in each orifice group (e.g., first to sixth orifices) for forming a pixel, a dot is formed on a recording medium by ink discharged from the first orifice of the array, and thereafter, the recording medium is transferred. When the dot reaches a position facing the second orifice of the array, ink is discharged from the second orifice, and a dot is formed at the same position as the former dot. In this manner, in each orifice group, one pixel is formed by the plurality of orifices.

According to this embodiment, in order to form one pixel, application intervals of the plurality of ink droplets can be shortened as compared to a conventional apparatus without being influenced by a response frequency (discharging minimum period). Therefore, a first ink droplet can be prevented from soaking in a recording medium, or the ink solvent can be prevented from evaporating between adjacent applications.

As a result, a pixel having a density according to the number of landing ink droplets can be obtained, and a high-gradation, sharp image can be obtained.

Furthermore, since one pixel is formed by ink droplets from different orifices, even if ink droplets discharged from the orifices suffer from variations, the variations can be averaged in pixel formation. Therefore, density variations (density nonuniformity) of a pixel to be formed can be reduced.

First Comparative Example

A comparative example pertinent to the present invention will be described below.

Figure 6:
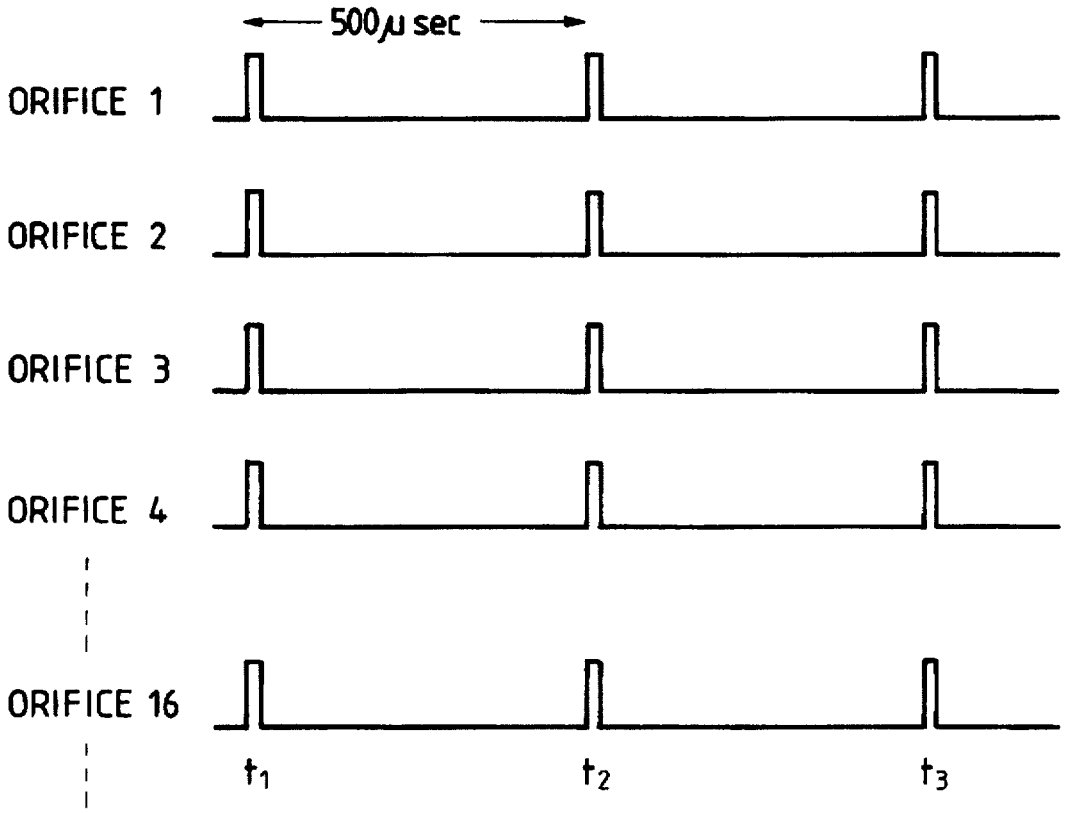
FIG. 6 is a timing chart according to a comparative example.
Figure 7:
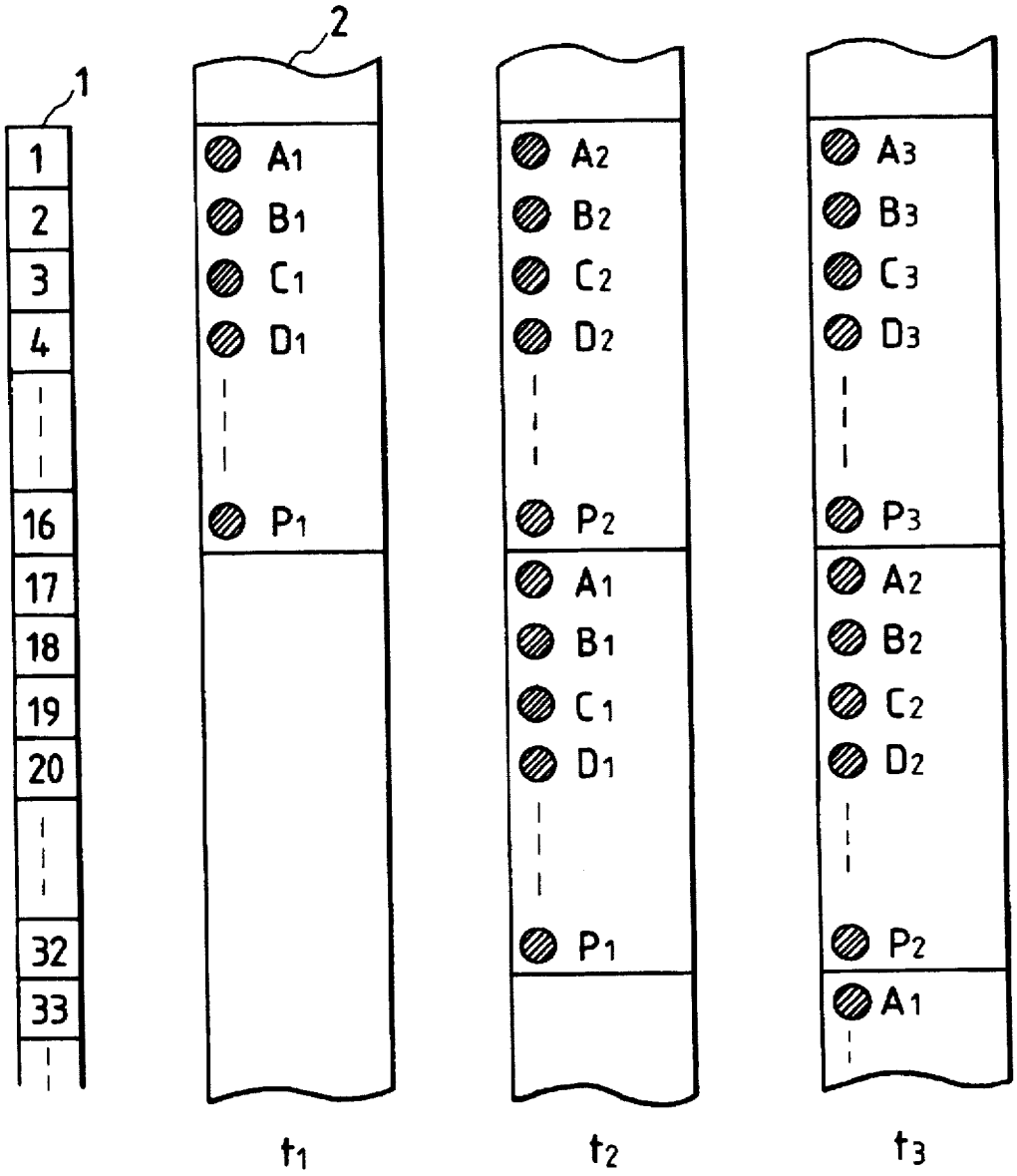
FIG. 7 is a chart showing a pixel forming process in a comparative example.

In the comparative example substantially the same recording operation as in the first embodiment is performed, except that a recording head which has 256 orifices at the same orifice density (16 orifices/mm) as that in the first embodiment is employed, a rotational speed of a drum is set to be 2,000 mm/sec, and a head drive timing is as shown in FIG. 6. FIG. 7 shows a pixel formation process at that time.

In this example, recording paper 2 on the drum is moved by 1 mm, i.e., 16 orifice pitches for 500 μsec. Therefore, when discharging operations are performed according to the timing chart shown in FIG. 6, for example, a first pixel (dot $A_1$ in FIG. 7) is formed by ink droplets discharged from 1st, 17th, 33rd, 49th, . . . , 241st orifices. An nth pixel is formed by ink droplets discharged from (k+16 m)th 16 pixels (m=0 to 15) where k is the remainder obtained by dividing n by 16. By changing the number of ink droplets to be discharged in accordance with an image signal, 17-value gradation recording can be performed.

According to this comparative example, since one pixel is formed by ink droplets from different orifices like in the first embodiment, even if ink droplets discharged from the orifices suffer from variations, the variations can be averaged in pixel formation. Therefore, density variations (density nonuniformity) of a pixel to be formed can be reduced, and gradation can be improved.

In the first embodiment and first comparative example, recording is performed while winding the recording paper around the drum. Even in a conventional serial type printer, an orifice array of a recording head can be mounted to lie parallel to the scanning direction, thus providing the same benefits as the above embodiments.

Second Comparative Example

The same recording head (orifice interval=63.5 μm) and the same ink-jet recording apparatus as those in the first embodiment were used, a rotational speed of a drum with recording paper was set to be 125 mm/sec, and recording was performed by discharging ink droplets from a single orifice at 500-μsec intervals like in the conventional apparatus to form one pixel. Note that the recording paper was moved by 63.5 μm equal to the orifice port interval during a 500-μsec interval.

When image recording was performed in this manner, an image in which a high-density portion had a relatively low density and slightly low gradation as compared to the first embodiment and first comparative example was obtained.

Note that as an ink used in the present invention, both water- and oil-based inks can be used. However, the water-based ink is preferable in terms of odor and safety.

As a recording medium used in the present invention, any media normally used in ink-jet recording, such as coated paper on a surface of which an ink receiving layer is formed, normal paper such as high-quality paper, letter paper, copy paper, and the like, a transparency film, and the like can be used. A recording medium such as coated paper on a surface of which an ink receiving layer is formed, a transparency film, or the like is preferably used to obtain a high-quality image.

Note that the present invention can provide a remarkable effect in a recording head and a recording apparatus which particularly employ a system wherein heat energy is applied to ink by a means for generating the heat energy (electrothermal converter, laser, or the like) to discharge ink among ink-jet recording systems. According to this system, high-density, high-quality recording can be attained.

As to its representative constitution and principle, for example, one practiced by use of the basic principle disclosed in, for example, U.S. Pat. Nos. 4,723,129 and 4,740,796 is prepared. This system is applicable to so called on-demand type devices. Particularly, the case of the on-demand type is effective because, by applying at least one driving signal which gives rapid temperature elevation exceeding nucleate boiling corresponding to the recording information on electrothermal converters arranged corresponding to the sheets or liquid channels holding liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into pulse shapes, growth and shrinkage of the bubble can be effected instantly and adequately to accomplish more preferably discharging of the liquid (ink) particularly excellent in response characteristic. As the driving signals of such pulse shape, those disclosed in U.S. Pat. Nos. 4,463,359 and 4,345,262 are suitable. Further excellent recording can be performed by employing of the conditions disclosed in U.S. Pat. No. 4,313,124 of the invention concerning the temperature elevation rate of the above-mentioned heat acting surface.

As the constitution of the recording head, in addition to the combination of discharging orifice, liquid channel, electrothermal converter (linear liquid channel or right angle liquid channel) as disclosed in the above-mentioned respective specifications, the constitution by use of U.S. Pat. Nos. 4,558,333, 4,459,600 disclosing the constitution having the heat acting portion arranged in the flexed region is also included in the present invention. In addition, the present invention can be also effectively made the constitution as disclosed in Japanese Patent Laid-Open Application No. 59-123670 which discloses the constitution using a slit common to a plurality of electrothermal converters as the discharging portion of the electrothermal converter or Japanese Patent Laid-Open Application No. 59-138461 which discloses the constitution having the opening for absorbing pressure wave of heat energy correspondent to the discharging portion.

In addition, the present invention is effective for a recording head of the freely exchangeable chip type which enables electrical connection to the main device or supply of ink from the main device by being mounted on the main device, or for the case by use of a recording head of the cartridge type provided integrally on the recording head itself.

Also, addition of a restoration means for the recording head, a preliminary auxiliary means, etc. provided as the constitution of the recording device of the present invention is preferable, because the effect of the present invention can be further stabilized. Specific examples of these may include, for the recording head, capping means, cleaning means, pressurization or aspiration means, electrothermal converters or another heating element or preliminary heating means according to a combination of these, and it is also effective for performing stable recording to perform preliminary mode which performs discharging separate from recording.

Further, as the recording mode of the recording device, the present invention is extremely effective for not only the recording mode only of a primary color such as black etc., but also a device equipped with at least one of several different colors or full color by color mixing, whether the recording head may be either integrally constituted or combined in plural number.

Moreover, in the embodiments of the present invention described above, a liquid ink is used. For example, an ink which is solidified at room temperature or lower, and is softened or liquidized at the room temperature, or an ink which is liquidized upon application of a use recording signal may be employed since an ink-jet recording system normally performs temperature adjustment of an ink itself within a range of 30° C. to 70° C. to temperature-control an ink viscosity to fall within a stable discharging range. In addition, a temperature rise caused by heat energy may be positively utilized as energy for changing the state of an ink from a solid state to a liquid state so as to prevent solidification of the ink, or ink which is solidified in a leaving state for the purpose of preventing evaporation of an ink may be used. In any case, the present invention is applicable to a case using an ink which can only be liquified by heat energy, such as an ink which is liquified upon application of heat energy according to a recording signal to discharge a liquid ink, or an ink which begins to be solidified when it reaches a recording medium. In these cases, ink may face electrothermal converters while being held in a liquid or solid state in a porous sheet recess portion or through holes, as disclosed in Japanese Patent Laid-Open Application No. 54-56847 or 60-71260. In the present invention, the above-mentioned film boiling method is most effectively executed for the above-mentioned inks.

In addition, the ink-jet recording apparatus of the present invention may be one used as an image output terminal of an information processing equipment such as a computer, a copying machine as a combination with a reader, or the like, a facsimile apparatus having a transmission/reception function, and the like.

What is claimed is:

1. A recording apparatus for recording an image having a density and which is formed from a plurality of dots of an ink of a particular color, each said dot being formed by at least one of a droplet deposited onto a same position of a recording medium, each dot having a size, the density of the image being a function of the size of each of the dots, comprising:

an ink jet recording head for discharging the droplets of the ink of the particular color from an array of a plurality of orifices, said orifices being disposed along an array direction, each of said ink droplets discharged by the orifices being of substantially equal quantity and colorant-concentrations;

drive means for driving said recording head in accordance with a recording signal to cause a first of said orifices to discharge at a first timing a first droplet of said ink onto a given location of said recording medium, and to cause a second of said orifices to discharge at a second timing a second droplet of said ink onto said given location of said recording medium, said first orifice and said second orifice being separated by a distance therebetween; and moving means for effecting relative movement between said recording head and said recording medium along a direction substantially parallel to said array direction by a length corresponding to said distance during a time interval between said first and said second timings by said drive means;

wherein said time interval is such that said second timing takes place while the ink discharged at said first timing onto said given location is liquid so that the ink discharged at said second timing is deposited onto said given location, whereby said second ink droplet is deposited atop said first ink droplet, and said first and said second ink droplets combine while liquid to form a said single dot on said given location of said recording medium so that the dot size is consistent, and wherein thus executed record operations are optionally repeated so as to discharge onto said given location an accumulated number of said ink droplets corresponding to a density level of an image to be formed on said given location.

2. An apparatus according to claim 1, wherein said moving means performs relative movement by rotating a rotary member around which said recording medium is wound.

3. An apparatus according to claim 1, wherein said moving means performs relative movement by scanning a carriage on which said recording head is mounted.

4. An apparatus according to claim 1, wherein said drive means drives an orifice adjacent to the first orifice as the second orifice.

5. An apparatus according to claim 1, wherein said drive means drives an orifice separated from the first orifice by a predetermined number of orifices as the second orifice.

6. An apparatus according to claim 1, wherein said recording head discharges inks of a plurality of colors.

7. An apparatus according to claim 1, wherein said recording head comprises energy generation means, arranged in correspondence with said orifices, for applying heat energy to an ink to cause a change in state, and causing said orifices to discharge the ink on the basis of the change in state, thereby forming flying liquid droplets.

8. An apparatus according to claim 7, wherein the change in state is growth of bubbles caused by film boiling.

9. An apparatus according to claim 1, further comprising supply means for supplying the recording signal to said drive means for driving said recording head.

10. An apparatus according to claim 9, wherein said supply means is a host computer.

11. An apparatus according to claim 9, wherein said supply means is a scanner having reading means.

12. An apparatus according to claim 9, wherein said supply means is a facsimile receiver.

13. An apparatus according to claim 1, wherein a density of said array is equal to a density of a plurality of pixels formed on said recording medium.

14. A recording apparatus according to claim 1, wherein said time interval between said first and said second timings is shorter than a time period for discharge of said ink from each of said plural orifices.

15. A recording apparatus for recording an image having a density and which is formed from a plurality of dots of an ink of a particular color, each said dot being formed by at least one of a droplet deposited onto a same position of a recording medium, thereby performing recording, each said dot having a size, the density of the image being a function of the size of each of the dots, comprising:

an ink jet recording head for discharging the droplets of the ink of the particular color from an array of a plurality of orifices, said orifices being disposed along an array direction, each of said ink droplets discharged by the orifices being of substantially equal quantity and colorant-concentrations;

drive means for driving said recording head in accordance with a recording signal, said drive means driving in sequence each said orifice in a group of said orifices at predetermined timings to discharge said ink as said succession of the ink droplets onto said same position of said recording medium, said group being used for forming the image; and moving means for effecting relative movement between said recording medium and said recording head along a direction substantially parallel to said array direction, during a time interval between a first drive timing associated with a given said orifice and a second drive timing associated with a next said orifice, by a length corresponding to a distance between said given orifice and said next orifice in accordance with a drive operation by said drive means;

wherein the predetermined timings of said drive means take place at a predetermined time interval which is such that said succession of ink droplets are deposited atop one another and combine while liquid to form one said dot on said same position of said recording medium, so that the dot size is consistent, and wherein thus executed record operations are repeated to discharge onto said given location an accumulated number of ink droplets corresponding to the density level of the image to be formed on said given location.

16. An apparatus according to claim 15, wherein said moving means performs relative movement by rotating a rotary member around which said recording medium is wound.

17. An apparatus according to claim 15, wherein said moving means performs relative movement by scanning a carriage on which said recording head is mounted.

18. An apparatus according to claim 15, wherein said drive means drives adjacent orifices as the group of orifices.

19. An apparatus according to claim 15, wherein said ink droplets are of at least two colors.

20. An apparatus according to claim 15, wherein said recording head comprises energy generation means, arranged in correspondence with said plurality of orifices, for applying heat energy to an ink to cause a change in state, and causing said plurality of orifices to discharge the ink on the basis of the change in state, thereby forming flying liquid droplets.

21. An apparatus according to claim 20, wherein the change in state is growth of bubbles caused by film boiling.

22. An apparatus according to claim 15, further comprising supply means for supplying the recording signal to said drive means for driving said recording head.

23. An apparatus according to claim 22, wherein said supply means is a host computer.

24. An apparatus according to claim 22, wherein said supply means is a scanner having reading means.

25. An apparatus according to claim 22, wherein said supply means is a facsimile receiver.

26. An apparatus according to claim 15, wherein said drive means sets a number of said orifices in said group which are to be driven in accordance with a density data of the recording signal corresponding to the pixel to be formed.

27. An apparatus according to claim 15, wherein a density of said array is equal to a density of said pixels formed on said recording medium.

28. A recording apparatus according to claim 15, wherein said time interval between said first and said second drive timings is shorter than a time period for discharge of said ink from each of said plural orifices.

29. A recording method for recording an image having a density and which is formed from a plurality of dots of an ink of a particular color, each said dot being formed by at least one of a droplet deposited onto a same position of a recording medium, the density of the image being a function of the size of each of the dot, comprising the steps of:

a first step of providing an ink jet recording head for discharging the droplets of the ink of the particular color from an array of a plurality of orifices, the orifices being disposed along an array direction, each of the ink droplets discharged by the orifices being of substantially equal quantity and colorant-concentrations;

a second step of causing a first orifice of the recording head to discharge a droplet of the ink onto a predetermined position of the recording medium;

a third step of moving, after said second step, said recording head relative to the recording medium so that a second said orifice is placed into registry with the predetermined position of said recording medium; and a fourth step of causing the second orifice to discharge another droplet of the ink onto the predetermined position of the recording medium after the third step;

wherein the second orifice is moved in the array direction, the fourth step is performed during a time interval in which the ink droplets discharged in the second and the fourth steps are combined while liquid at the predetermined position to form one dot on the recording medium, so that the dot size is consistent, and the inks discharged in the second and the fourth steps have the same color; and repeating thus executed record operations to discharge onto the given location an accumulated number of ink droplets corresponding to a density level of an image to be formed on the given location.

30. A method according to claim 29, wherein the relative movement is performed by rotating a rotary member around which said recording medium is wound.

31. A method according to claim 29, wherein the relative movement is performed by scanning a carriage on which said recording head is mounted.

32. A method according to claim 29, wherein the first orifice is adjacent to the second orifice.

33. A method according to claim 29, wherein the first and second orifices are separated by a predetermined number of orifices.

34. A method according to claim 29, wherein said recording head comprises energy generation means, arranged in correspondence with said orifices, for applying heat energy to an ink to cause a change in state, and causing said orifices to discharge the ink on the basis of the change in state, thereby forming flying liquid droplets.

35. A method according to claim 34, wherein the change in state is growth of bubbles caused by film boiling.

36. An apparatus according to claim 29, wherein a density of said array is equal to a density of a plurality of pixels formed on said recording medium.

37. A recording apparatus according to claim 29, wherein said time interval between said first and said second steps is shorter than a time period for discharge of said ink from each of said plural orifices.

* * * * *

UNITED STATES PATENT AND TRADEMARK OFFICE

CERTIFICATE OF CORRECTION

PATENT NO. : 5,726,691

DATED : March 10, 1998

INVENTOR(S) : MAKOTO SHIOYA, ET AL.

It is certified that error appears in the above-identified patent and that said Letters Patent is hereby corrected as shown below:

AT [57] ABSTRACT

Line 1, "apparatus;" should read --apparatus--.

COLUMN 1

Line 44, "been" should be deleted.

COLUMN 2

Line 40, close up right margin;
Line 41, close up left margin;
Line 50, close up right margin;
Line 51, close up left margin;
Line 53, close up right margin;
Line 54, close up left margin;
Line 56, close up right margin; and
Line 57, close up left margin.

COLUMN 3

Line 63, "dew drop" should read --dew drops--.

COLUMN 5

Line 3, " to have" should be deleted.
Line 4, "100 μsec" should read --100 μsec,--; and
Line 55, "example" should read --example,--.

UNITED STATES PATENT AND TRADEMARK OFFICE

CERTIFICATE OF CORRECTION

PATENT NO. : 5,726,691

DATED : March 10, 1998

INVENTOR(S) : MAKOTO SHIOYA, ET AL.

It is certified that error appears in the above-identified patent and that said Letters Patent is hereby corrected as shown below:

COLUMN 10

Line 50, "dot," should read --dots,--.

COLUMN 12

Line 12, "An apparatus" should read --A method--; and
Line 15, "recording apparatus" should read --method--.

Signed and Sealed this

Thirteenth Day of October 1998

*Attest:*

*Attesting Officer*

BRUCE LEHMAN

*Commissioner of Patents and Trademarks*